US006070409A

United States Patent [19]

Kaiser

[11] Patent Number: 6,070,409

[45] Date of Patent: Jun. 6, 2000

[54] ENGINE FOR POWERING BY WATER

[76] Inventor: Arthur W. Kaiser, 15 Valley Road, Wappinger Falls, N.Y. 12590

[21] Appl. No.: 09/176,283

[22] Filed: Oct. 21, 1998

[51] Int. Cl.[7] ..... F01C 1/344

[52] U.S. Cl. ..... 60/512; 60/513; 418/261

[58] Field of Search ..... 418/264, 261; 60/512, 513, 670

[56] References Cited

U.S. PATENT DOCUMENTS

| | | | |
|---|---|---|---|
| 712,456 | 10/1902 | Janssen | 418/264 |
| 1,530,307 | 3/1925 | Dawson | 60/513 |
| 3,869,231 | 3/1975 | Adams | 418/267 |
| 3,905,195 | 9/1975 | Gregory | 60/512 |
| 4,004,556 | 1/1977 | Pfeiffer | 123/8.45 |
| 4,416,113 | 11/1983 | Portillo | 60/513 |
| 4,486,158 | 12/1984 | Maruyama et al. | 418/39 |
| 4,746,280 | 5/1988 | Wystemp et al. | 418/268 |
| 5,524,587 | 6/1996 | Mallen et al. | 123/243 |

FOREIGN PATENT DOCUMENTS 57-65869 4/1982 Japan .

*Primary Examiner*—Andrew M. Dolinar
*Attorney, Agent, or Firm*—Richard L. Miller, P.E.

[57] ABSTRACT

An engine for powering by water that includes a stator, a rotor rotatably mounted in the stator, and a plurality of blades movably mounted in the rotor. The stator has a throughchamber. The rotor is rotatably mounted in the throughchamber. By virtue of a throughbore in a top plate of the stator being offset from its longitudinal axis, a throughbore in a bottom plate of the stator being offset from its longitudinal axis, and a throughbore in the rotor being along its longitudinal axis, the rotor is offset in the throughchamber and has only one tangential point contacting a circular periphery of throughchamber at any one time as it rotates in the stator. The rotor rotates clockwise in the stator, by steam applying a greater force on a blade of a pair of blades of three blades that define a communicating power chamber that protrudes further than another blade of the pair of blades, by virtue of the fact that it presents a greater surface area exposed to the steam.

21 Claims, 3 Drawing Sheets

ENGINE FOR POWERING BY WATER

BACKGROUND OF THE INVENTION

1. Field of the Invention

The present invention relates to an engine. More particularly, the present invention relates to an engine for powering by water.

2. Description of the Prior Art

Numerous innovations for vane engines have been provided in the prior art that will be described. Even though these innovations may be suitable for the specific individual purposes to which they address, however, they differ from the present invention.

A FIRST EXAMPLE, U.S. Pat. No. 3,869,231 to Adams teaches a vane type fluid energy translating device that has a rotor with a plurality of vane slots each containing a movable vane which traverses the inner surface of a cam ring. Each vane has leading and trailing face which are nonparallel and when one face is subject to a higher fluid pressure the other face is acted on by a reaction force between it and the rotor which force has a component that biases the vane outwardly of its rotor slot toward engagement with the cam ring.

A SECOND EXAMPLE, U.S. Pat. No. 4,004,556 to Pfeiffer teaches a rotary internal combustion engine of axial sliding vane type that has sinusoidal shaped side walls with compensation of the mass forces allowing nearly friction-free and high speed operation with sufficient compression ratio. High power output is believed to make the invention comparable to the well-known Wankel engine. The various designs of the rotary machines can also be used as fluid pumps or fluid-operated motors.

A THIRD EXAMPLE, U.S. Pat. No. 4,486,158 to Maruyama et al. teaches a sliding vane type rotary compressor, of which refrigerating capacity at the high speed operation of the compressor is suppressed by making use of suction loss involved when refrigerant pressure in the vane chamber becomes lower than the pressure of the refrigerant supply source in the suction stroke of the compressor. The compressor has a rotor, vanes slidably carried by the rotor, a cylinder accommodating the rotor and the vane, side plates fixed to both sides of the cylinder for closing both open ends of the vane chambers defined by the rotor, vanes and cylinder, and suction and discharge ports serving as passages for communicating the vane chambers with the outside of the compressor. A spacer for adjustment of the refrigerating capacity is disposed in the suction port. When the compressor of the invention is used in the refrigeration cycle of an automobile air conditioner, it is possible to obtain a desired refrigerating capacity controlling characteristics of the compressor matching the characteristics of the associated engine and automobile, simply by selecting a suitable spacer and mounting the same in the sucking section of the compressor, without substantially changing other parts of the compressor.

A FOURTH EXAMPLE, U.S. Pat. No. 4,746,280 to Wystemp et al. teaches a sliding vane pump having a hydraulic vane actuation system. The pump includes a case with a liner having an eccentric surface therein. A rotor and shaft rotate within the liner. The rotor has a plurality of radial slots therein, with a vane slidably disposed in each of the slots. Each vane has a radially inner edge with first and second sides extending substantially normally therefrom. A radially outer edge extends normally from the first side and its opposite and substantially parallel to the radially inner edge. A beveled edge extends radially inwardly from the outer edge and interconnects the outer edge with the second side. As the rotor rotates, the beveled edge is the leading edge of the vane. A plurality of radially oriented holes are defined through each vane. The holes intersect the inner edge and a portion of the beveled edge and a portion of the outer edge. Fluid travels radially inwardly and outwardly through the holes in the vanes as the rotor rotates, providing hydraulic actuation of the vanes outwardly, as well as providing fluid relief therefor.

A FIFTH EXAMPLE, U.S. Pat. No. 5,524,587 to Mallen et al. teaches a sliding vane engine, where the vanes slide with at least of one of an axial and radial component of vane motion, and where the compression ratio of the engine may be variably controlled. The engine includes a stator and a rotor in relative rotation, and a plurality of vanes in rotor slits defining one or more main chamber cells and one or more vane slit cells. The vanes contain extended pins that move in a pin channel for controlling the sliding motion of the vane. Fuel is mixed by incorporating air turbulence generators at or near the intake region. The intake and exhaust regions of the engine also incorporate a wave pumping mechanism for injecting and scavenging air from the main chamber cells and the vane slits. The compression ratio of the engine may be varied while the engine is in operation, and the engine geometry provides for an extended temporal duration at about peak compression. The engine is insulated by using segmented ceramic inserts on the stator and rotor surfaces.

It is apparent that numerous innovations for vane engines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an engine for powering by water that avoids the disadvantages of the prior art.

ANOTHER OBJECT of the present invention is to provide an engine for powering by water that is simple and inexpensive to manufacture.

STILL ANOTHER OBJECT of the present invention is to provide an engine for powering by water that is simple to use.

BRIEFLY STATED, YET ANOTHER OBJECT of the present invention is to provide an engine for powering by water that includes a stator, a rotor rotatably mounted in the stator, and a plurality of blades movably mounted in the rotor. The stator has a throughchamber. The rotor is rotatably mounted in the throughchamber. By virtue of a throughbore in a top plate of the stator being offset from its longitudinal axis, a throughbore in a bottom plate of the stator being offset from its longitudinal axis, and a throughbore in the rotor being along its longitudinal axis, the rotor is offset in the throughchamber and has only one tangential point contacting a circular periphery of throughchamber at any one time as it rotates in the stator. The rotor rotates clockwise in the stator, by steam applying a greater force on a blade of a pair of blades of three blades that define a communicating power chamber that protrudes further than another blade of the pair of blades, by virtue of the fact that it presents a greater surface area exposed to the steam.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows.

LIST OF REFERENCE NUMERALS UTILIZED IN THE DRAWING

Figure 1:
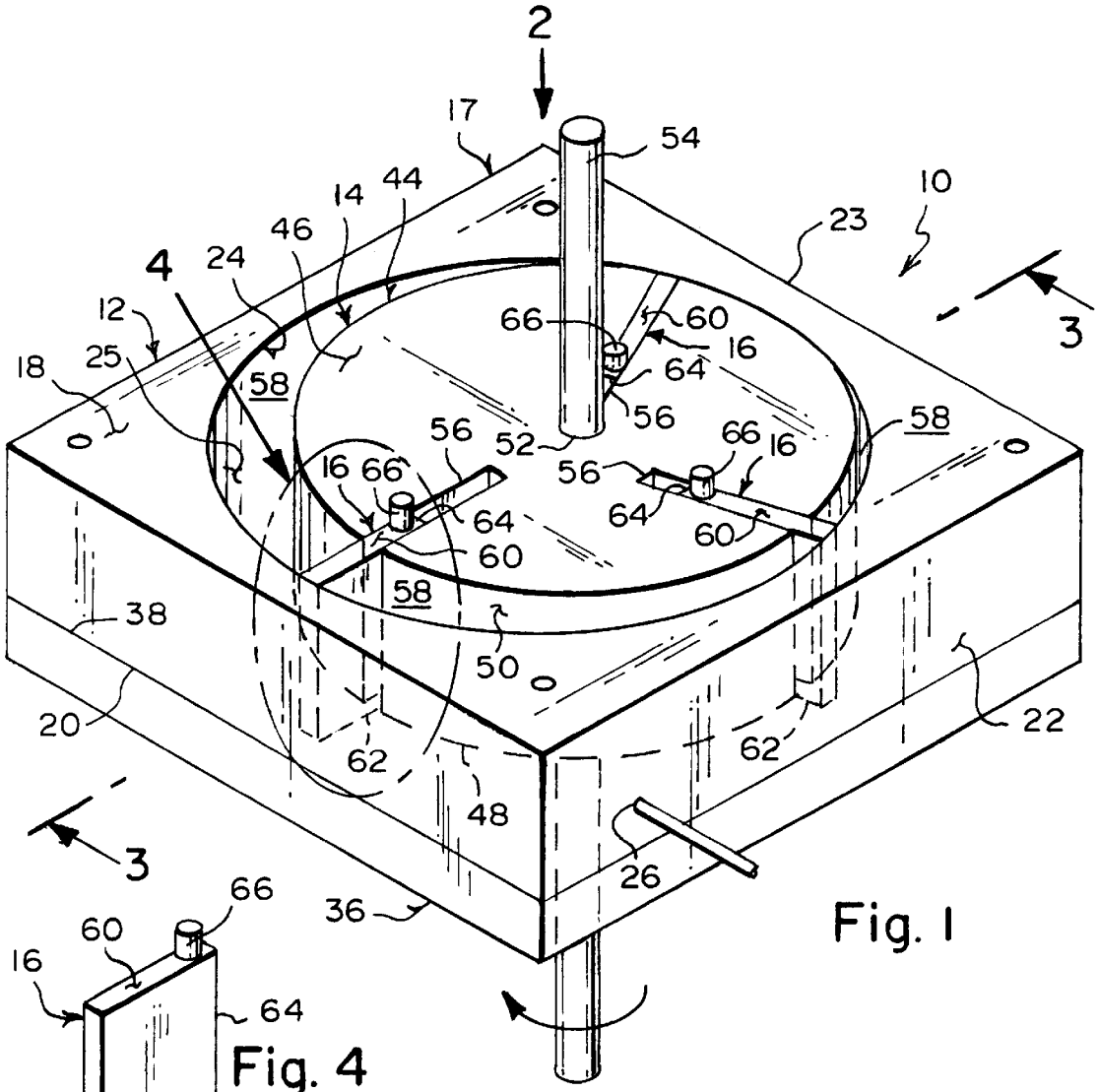
FIG. 1 is a diagrammatic perspective view of the present invention with the top plate removed.
Figure 4:
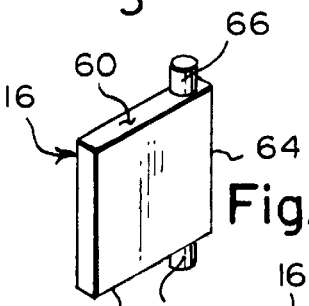
FIG. 4 is a diagrammatic perspective view of the area generally enclosed by the dotted circle identified by arrow 4 in FIG. 1 of a single blade of the present invention.
Figure 3:
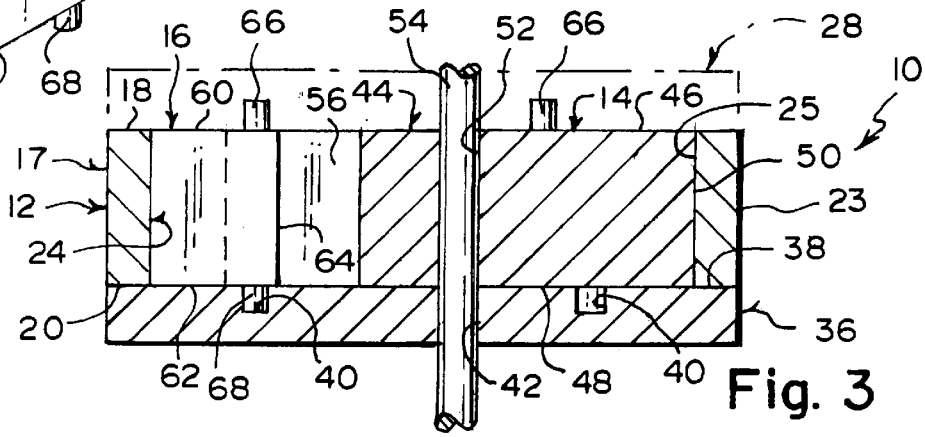
FIG. 3 is a reduced diagrammatic cross sectional view taken on line 3—3 in FIG. 1.
Figure 2:
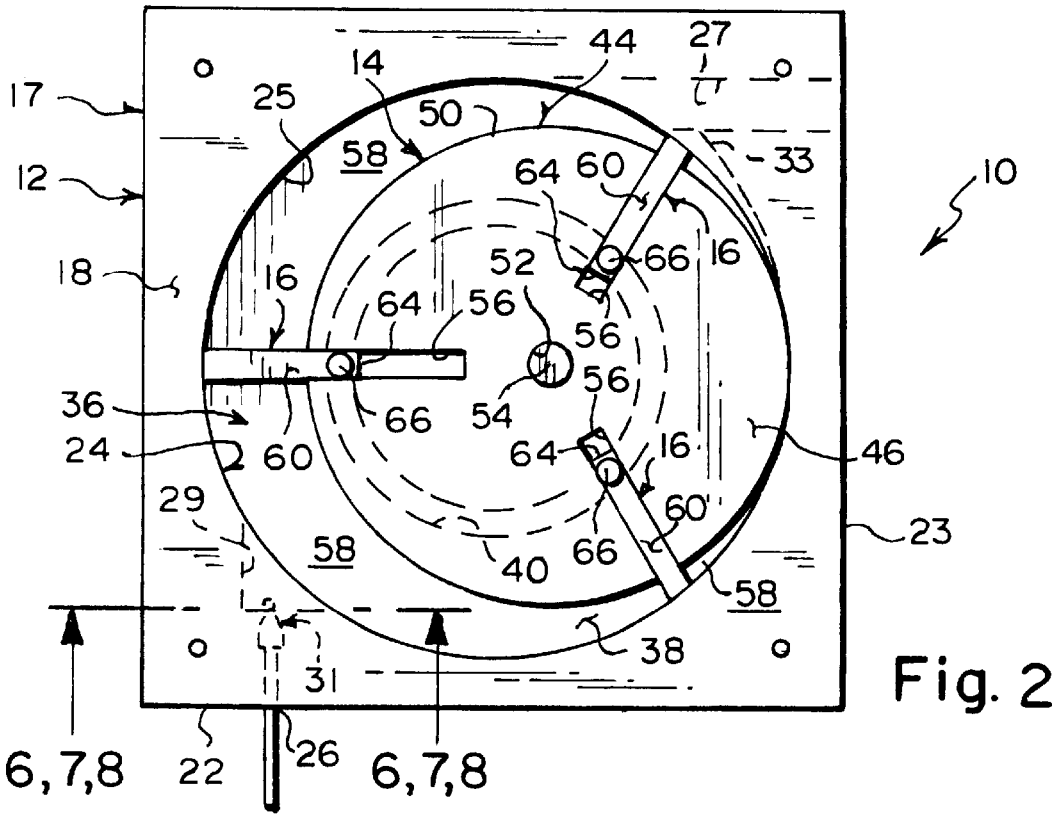
FIG. 2 is a reduced diagrammatic top plan view taken generally in the direction of arrow 2 in FIG. 1.
Figure 5:
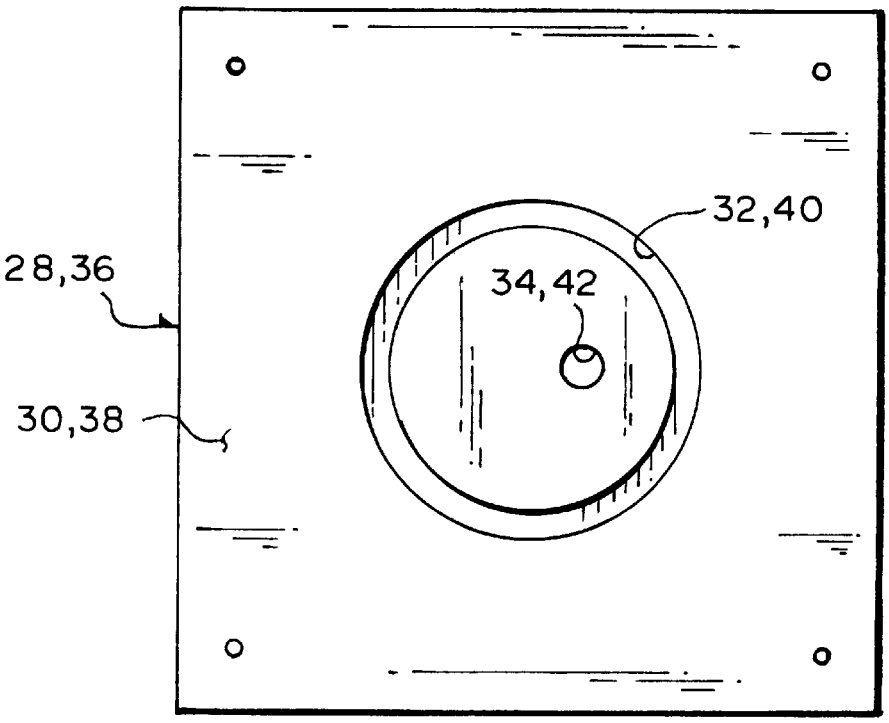
FIG. 5 is a diagrammatic plan view taken in the direction of inner surfaces of the top and bottom plates of the present invention.

10 engine for powering by water of the present invention
12 stator
14 rotor
16 plurality of blades 16
17 stator body of stator 12
18 uppermost face of stator body 17 of stator 12
20 lowermost face of stator body 17 of stator 12
22 first side face of stator body 17 of stator 12
23 second side face of stator body 17 of stator 12
24 throughchamber in stator body 17 of stator 12
25 circular periphery defining throughchamber 24 in stator body 17 of stator 12
26 intake port in stator body 17 of stator 12
27 exhaust port in stator body 17 of stator 12
28 top plate of stator 12
29 steam generating chamber of intake port 26 in stator body 17 of stator 12
30 lowermost face of top plate 28 of stator 12
31 steam generating apparatus in steam generating chamber 29 of intake port 26 in stator body 17 of stator 12
32 annular groove in lowermost face 30 of top plate 28 of stator 12
33 branch of exhaust port 27 in stator body 17 of stator 12
34 throughbore in top plate 28 of stator body 17 of stator 12
36 bottom plate of stator 12
38 uppermost face of bottom plate 36 of stator 12
40 annular groove in uppermost face 38 of bottom plate 36 of stator 12
42 throughbore in bottom plate 36 of stator 12
44 rotor body of rotor 14
46 uppermost face of rotor body 44 of rotor 14
48 lowermost face of rotor body 44 of rotor 14
50 circular periphery of rotor body 44 of rotor 14
52 throughbore in rotor body 44 of rotor 14
54 shaft of rotor 14
56 three slots in rotor body 44 of rotor 14
58 plurality of power chambers dividing throughchamber 24 in stator body 17 of stator 12
60 uppermost face of each blade of three blades 16
62 lowermost face of each blade of three blades 16
64 innermost face of each blade of three blades 16
66 uppermost mini-shaft 66 on each blade oL three blades 16
68 lowermost mini-shaft 68 on each blade of three blades 16

First Embodiment of Steam Generating Apparatus 31

131 steam generating apparatus 131
170 high intensity arc mechanism for converting water entering steam generating chamber 29 in stator body 17 of stator 12 through intake port 26 in stator body 17 of stator into steam

Second Embodiment of Steam Generating Apparatus 31

231 steam generating apparatus
270 laser beam generator mechanism for converting water entering steam generating chamber 29 in stator body 17 of stator 12 through intake port 26 in stator body 17 of stator into steam

Third Embodiment of Steam Generating Apparatus 31

331 steam generating apparatus
370 heating element mechanism for converting water entering steam generating chamber 29 in stator body 17 of stator 12 through intake port 26 in stator body 17 of stator into steam

DETAILED DESCRIPTION OF THE PREFERRED EMBODIMENT

Referring now to the drawing, in which like numerals indicate like parts, and particularly to FIG. 1, the engine for powering by water of the present invention is shown generally 10, The configuration of the engine for powering by water 10 can best be seen in FIGS. 1–5, and as such, will be discussed with reference thereto.

The engine for powering by water 10 comprises a stator 12, a rotor 14 rotatably mounted in the stator 12, and a plurality of blades 16 movably mounted in the rotor 14.

The stator 12 comprises a stator body 17 that is generally rectangular-parallelepiped-shaped.

The stator body 17 of the stator 12 has an uppermost face 18, a lowermost face 20 disposed below, and parallel to, the uppermost face 18 of the stator body 17 of the stator 12, a first side face 22, and a second side face 23 that is perpendicular to the first side face 22 of the stator body 17 of the stator 12.

The stator body 17 of the stator 12 further has a throughchamber 24 that is cylindrically-shaped and extends concentrically and axially through the stator body 17 of the stator 12 from, and opens into, the uppermost face 18 of the stator body 17 of the stator 12, to, and opens into, the lowermost face 20 of the stator body 17 of the stator 12, and is defined by a circular periphery 25.

The stator body 17 of the stator 12 further has an intake port 26 that extends transversely from, and opens into, the first side face 22 of the stator body 17 of the stator 12, to, and widens into a steam generating chamber 29 with steam generating apparatus 31 therein for generating steam as it communicates with the throughchamber 24 in the stator body 17 of the stator 12.

The stator body 17 of the stator 12 further has an exhaust port 27 that extends transversely from, and opens into, the second face 23 of the stator body 17 of the stator 12, to, and communicates tangentially with, the throughchamber 24 in the stator body 17 of the stator 12, and has a branch 33 that extends transversely therefrom into the throughchamber 24 in the stator body 17 of the stator 12 to allow for full exhaust as the rotor 14 rotates to its only tangential contact point with the stator 12.

The stator 12 further comprises a top plate 28 that is thin and rectangular-shaped and sized to match, while replaceably overlying, the uppermost face 18 of the stator body 17 of the stator 12, and has a lowermost face 30 that contacts the uppermost face 18 of the stator body 17 of the stator 12 and a longitudinal axis.

The lowermost face 30 of the top plate 28 of the stator 12 has an annular groove 32 that extends completely therearound, concentrically inward of the throughchamber 24 in the stator body 17 of the stator 12.

The top plate 28 of the stator body 17 of the stator 12 further has a throughbore 34 that extends axially therethrough, offset from the longitudinal axis of the top plate 28.

The stator 12 further comprises a bottom plate 36 that is thin and rectangular-shaped and sized to match, while replaceably overlying, the lowermost face 20 of the stator body 17 of the stator 12, and has an uppermost face 38 that contacts the lowermost face 20 of the stator body 17 of the stator 12 and a longitudinal axis.

The uppermost face 38 of the bottom plate 36 of the stator 12 has an annular groove 40 that extends completely therearound, concentrically inward of the throughchamber 24 in the stator body 17 of the stator 12 and in vertical alignment with the annular groove 32 in the lowermost face 30 of the top plate 28 of the stator 12.

The bottom plate 36 of the stator 12 further has a throughbore 42 that extends axially therethrough, offset from the longitudinal axis of the bottom plate 36, and in vertical alignment with the throughbore 34 in the top plate 28 of the stator body 17 of the stator 12.

The rotor 14 comprises a rotor body 44 that is cylindrically-shaped and rotatably mounted in the throughchamber 24 in the stator body 17 of the stator 12.

The rotor body 44 of the rotor 14 has a longitudinal axis, an uppermost face 46 that is coplanar with the uppermost face 18 of the stator body 17 of the stator 12, a lowermost face 48 disposed below, and parallel to, the uppermost face 46 of the rotor body 44 of the rotor stator 14 and coplanar with the lowermost face 20 of the stator body 17 of the stator 12, and a circular periphery 50.

The rotor body 44 of the rotor 14 further has a throughbore 52 that extends axially therethrough, from the uppermost face 46 of the rotor body 44 of the rotor 14 to the lowermost face 48 of the rotor body 44 of the rotor 14, along the longitudinal axis of the rotor body 44 of the rotor 14 and in vertical alignment with both the throughbore 42 in the bottom plate 36 of the stator 12 and the throughbore 34 in the oto plate 28 of the stator 12.

The rotor 14 further comprises a shaft 54 that extends through the throughbore 52 in the rotor body 44 of the rotor 14 for rotation therewith, and rotatably through both the throughbore 42 in the bottom plate 36 of the stator 12 and the throughbore 34 in the top plate 28 of the stator 12, and by virtue of the throughbore 34 in the top plate 28 of the stator body 17 of the stator 12 being offset from the longitudinal axis of the top plate 28, the throughbore 42 in the bottom plate 36 of the stator 12 being offset from the longitudinal axis of the bottom plate 36, and the throughbore 52 in the rotor body 44 of the rotor 14 being along the longitudinal axis of the rotor body 44 of the rotor 14, the rotor body 44 of the rotor 14 is offset in the throughchamber 24 in the stator body 17 of the stator 12 and has only one tangential point contacting the circular periphery 25 of the throughchamber 24 in the stator body 17 of the stator 12 at any one time as it rotates in the stator 12.

The rotor body 44 of the rotor 14 further has three slots 56 that are thin and rectangular-shaped, spaced 120 degrees apart, and extend radially inward from, and open into, the circular periphery of the rotor body 44 of the rotor 14 and communicate with the throughchamber 24 in the stator body 17 of the stator 12, to short of the longitudinal axis of the rotor body 44 of the rotor 14, but inwardly past the annular groove 32 in the lowermost face 30 of the top plate 28 of the stator 12 and the annular groove 40 in the uppermost face 38 of the bottom plate 36 of the stator 12.

The three slots 56 in the rotor body 44 of the rotor 14 further extend from, and open into, the uppermost faces 46 of the rotor body 44 of the rotor 14, to, and open into, the lowermost face 48 of the rotor body 44 of the rotor 14.

The plurality of blades 16 are three blades.

Each blade of the three blades 16 is thin and rectangular-shaped, and radially slidably disposed in, and has an identical size and shape as, a respective slot of the three slots in the rotor body 44 of the rotor 14.

Each blade of the three blades 16 slidably extends to constantly contact the circular periphery of the throughchamber 24 in the stator body 17 of the stator 12, without leaving the respective slot of the three slots in the rotor body 44 of the rotor 14, with the three blades 16 dividing the throughchamber 24 in the stator body 17 of the stator 12 into a plurality of power chambers 58, and with a power chamber of the plurality of power chambers 58 that communicates with the steam generating chamber 29 forming a communicating power chamber.

Each blade of the three blades 16 has an uppermost face 60 that is coplanar with the uppermost face 46 of the rotor body 44 of the rotor 14, a lowermost face 62 that is disposed below, and parallel to, the uppermost face 60 thereof and coplanar with the lowermost face 48 of the rotor body 44 of the rotor 14, and an innermost face 64 that faces the longitudinal axis of the rotor body 44 of the rotor 14.

Each blade of the three blades 16 further has an uppermost mini-shaft 66 that extends vertically upwardly from the uppermost face 60 thereof, in close proximity of the innermost face 48 thereof, and rides in the annular groove 32 in the lowermost face 30 of the top plate 28 of the stator 12.

Each blade of the three blades 16 further has a lowermost mini-shaft 68 that depends vertically from the lowermost face 62 thereof, in close proximity of the innermost face 48 thereof, and in vertical alignment with the uppermost mini-shaft 66 thereof, and rides in the annular groove 40 in the uppermost face 38 of the bottom plate 36 of the stator 12, with the rotor 14 rotating clockwise in the stator 12 by the steam applying a greater force on a blade of a pair of blades of the three blades 16 that define the communicating power chamber of the plurality of power chambers 58 that protrudes further than another blade of the pair of blades of the three blades 16 that define the communicating power chamber of the plurality of power chambers 58 by virtue of the fact that it presents a greater surface area exposed to the steam.

Figure 6:
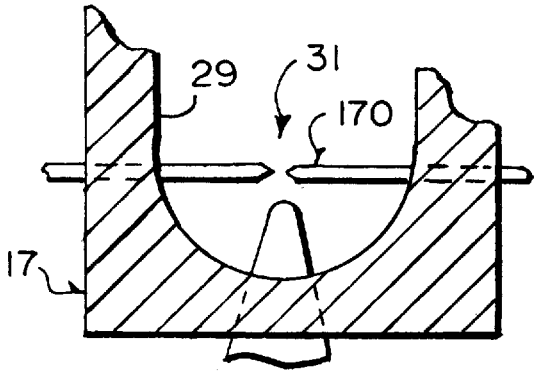
FIG. 6 is an enlarged diagrammatic cross sectional view taken on line 6—6 in FIG. 2 of the steam generating chamber of the present invention utilizing a high intensity arc mechanism.

The configuration a first embodiment of the steam generating apparatus 131 can best be seen in FIG. 6, and as such, will be discussed with reference thereto.

The steam generating apparatus 131 comprises a high intensity arc mechanism 170 for converting the water entering the steam generating chamber 29 in the stator body 17 of the stator 12 through the intake port 26 in the stator body 17 of the stator into the steam.

Figure 7:
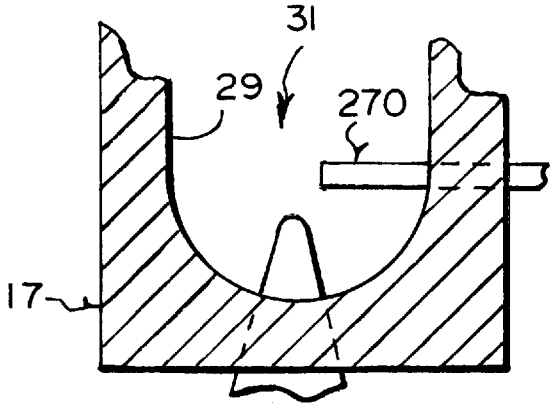
FIG. 7 is an enlarged diagrammatic cross sectional view taken on line 7—7 in FIG. 2 of the steam generating chamber of the present invention utilizing a laser beam generator mechanism.

The configuration a second embodiment of the steam generating apparatus 231 can best be seen in FIG. 7, and as such, will be discussed with reference thereto.

The steam generating apparatus 231 comprises a laser beam generator mechanism 270 for converting the water entering the steam generating chamber 29 in the stator body 17 of the stator 12 through the intake port 26 in the stator body 17 of the stator into the steam.

Figure 8:
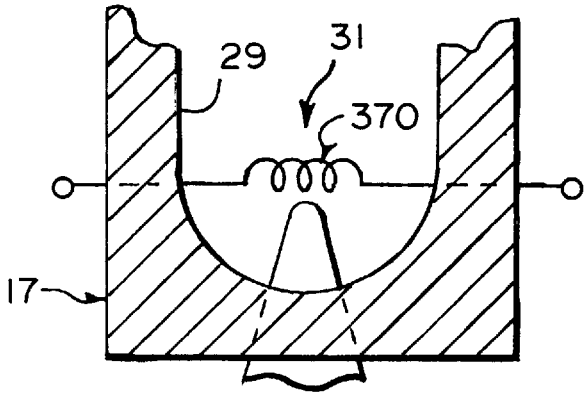
FIG. 8 is an enlarged diagrammatic cross sectional view taken on line 8—8 in FIG. 2 of the steam generating chamber of the present invention utilizing a heating element mechanism.

The configuration a third embodiment of the steam generating apparatus 331 can best be seen in FIG. 8, and as such, will be discussed with reference thereto.

The steam generating apparatus 331 comprises a heating element mechanism 370 for converting the water entering the steam generating chamber 29 in the stator body 17 of the stator 12 through the intake port 26 in the stator body 17 of the stator into the steam.

It will be understood that each of the elements described above, or two or more together, may also find a useful application in other types of constructions differing from the types described above.

While the invention has been illustrated and described as embodied in an engine for powering by water, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An engine for powering by water, comprising:

a) a stator;

b) a rotor rotatably mounted in said stator; and c) a plurality of blades movably mounted in said rotor, wherein said stator comprises a stator body that is generally rectangular-parallelepiped-shaped, wherein said stator body of said stator has;

i) an uppermost face;

ii) a lowermost face disposed below, and parallel to, said uppermost face of said stator body of said stator;

iii) a first side face; and iv) a second side face that is perpendicular to said first side face of said stator body of said stator, wherein said stator body of said stator further has a throughchamber that is cylindrically-shaped and extends concentrically and axially through said stator body of said stator from, and opens into, said uppermost face of said stator body of said stator, to, and opens into, said lowermost face of said stator body of said stator, and is defined by a circular periphery, wherein said stator body of said stator further has an intake port that extends transversely from, and opens into, said first side face of said stator body of said stator, to, and widens into a steam generating chamber with steam generating apparatus therein for generating steam as it communicates with said throughchamber in said stator body of said stator, wherein said stator body further comprises a top plate that is thin and rectangular-shaped and sized to match, while replaceably overlying, said uppermost face of said stator body of said stator, and has;

I) a lowermost face that contacts said uppermost face of said stator body of said stator; and II) a longitudinal axis, wherein said lowermost face of said top plate of said stator has an annular groove that extends completely therearound, concentrically inward of said throughchamber in said stator body of said stator.

2. The engine as defined in claim 1, wherein said top plate of said stator body of said stator further has a throughbore that extends axially therethrough, offset from said longitudinal axis of said top plate.

3. The engine as defined in claim 2, wherein said stator further comprises a bottom plate that is thin and rectangular-shaped and sized to match, while replaceably overlying, said lowermost face of said stator body of said stator, and has:

a) an uppermost face that contacts said lowermost face of said stator body of said stator; and b) a longitudinal axis.

4. The engine as defined in claim 3, wherein said uppermost face of said bottom plate of said stator has an annular groove that extends completely therearound, concentrically inward of said throughchamber in said stator body of said stator and in vertical alignment with said annular groove in said lowermost face of said top plate of said stator.

5. The engine as defined in claim 4, wherein said bottom plate of said stator further has a throughbore that extends axially therethrough, offset from said longitudinal axis of said bottom plate, and in vertical alignment with said throughbore in said top plate of said stator body of said stator.

6. The engine as defined in claim 5, wherein said rotor comprises a rotor body that is cylindrically-shaped and rotatably mounted in said throughchamber in said stator body of said stator.

7. The engine as defined in claim 6, wherein said rotor body of said rotor has:

a) a longitudinal axis;

b) an uppermost face that is coplanar with said uppermost face of said stator body of said stator;

c) a lowermost face disposed below, and parallel to, said uppermost face of said rotor body of said rotor and coplanar with said lowermost face of said stator body of said stator; and d) a circular periphery.

8. The engine as defined in claim 7, wherein said rotor body of said rotor further has a throughbore that extends axially therethrough, from said uppermost face of said rotor body of said rotor to said lowermost face of said rotor body of said rotor, along said longitudinal axis of said rotor body of said rotor and in vertical alignment with both said throughbore in said bottom plate of said stator and said throughbore in said oto plate of said stator.

9. The engine as defined in claim 8, wherein said rotor further comprises a shaft that extends through said throughbore in said rotor body of said rotor for rotation therewith, and rotatably through both said throughbore in said bottom plate of said stator and said throughbore in said top plate of said stator, and by virtue of said throughbore in said top plate of said stator body of said stator being offset from said longitudinal axis of said top plate, said throughbore in said bottom plate of said stator being offset from said longitudinal axis of said bottom plate, and said throughbore in said rotor body of said rotor being along said longitudinal axis of said rotor body of said rotor, said rotor body of said rotor is offset in said throughchamber in said stator body of said stator and has only one tangential point contacting said circular periphery of said throughchamber in said stator body of said stator at any one time as it rotates in said stator.

10. The engine as defined in claim 7, wherein said rotor body of said rotor further has three slots that are thin and rectangular-shaped, spaced 120 degrees apart, and extend radially inward from, and open into, said circular periphery of said rotor body of said rotor and communicate with said throughchamber in said stator body of said stator, to short of said longitudinal axis of said rotor body of said rotor, but inwardly past said annular groove in said lowermost face of said top plate of said stator and said annular groove in said uppermost face of said bottom plate of said stator.

11. The engine as defined in claim 10, wherein said three slots in said rotor body of said rotor further extend from, and open into, said uppermost faces of said rotor body of said rotor, to, and open into, said lowermost face of said rotor body of said rotor.

12. The engine as defined in claim 10, wherein said plurality of blades are three blades.

13. The engine as defined in claim 12, wherein each blade of said three blades is thin and rectangular-shaped, and radially slidably disposed in, and has an identical size and shape as, a respective slot of said three slots in said rotor body of said rotor.

14. The engine as defined in claim 12, wherein each blade of said three blades slidably extends to constantly contact said circular periphery of said throughchamber in said stator body of said stator, without leaving a respective slot of said three slots in said rotor body of said rotor, with said three blades dividing said throughchamber in said stator body of said stator into a plurality of power chambers, with a power chamber of said plurality of power chambers that communicates with the steam generating chamber forming a communicating power chamber.

15. The engine as defined in claim 14, wherein each blade of said three blades has;

a) an uppermost face that is coplanar with said uppermost face of said rotor body of said rotor;

b) a lowermost face that is disposed below, and parallel to, said uppermost face thereof and coplanar with said lowermost face of said rotor body of said rotor; and c) an innermost face that faces said longitudinal axis of said rotor body of said rotor.

16. The engine as defined in claim 15, wherein each blade of said three blades further has an uppermost mini-shaft that extends vertically upwardly from said uppermost face thereof, in close proximity of said innermost face thereof, and rides in said annular groove in said lowermost face of said top plate of said stator.

17. The engine as defined in claim 16, wherein each blade of said three blades further has a lowermost mini-shaft that depends vertically from said lowermost face thereof, in close proximity of said innermost face thereof, and in vertical alignment with said uppermost mini-shaft thereof, and rides in said annular groove in said uppermost face of said bottom plate of said stator, with said rotor rotating clockwise in said stator, by the steam applying a greater force on a blade of a pair of blades of said three blades that define said communicating power chamber of said plurality of power chambers that protrudes further than another blade of said pair of blades of said three blades that define said communicating power chamber of said plurality of power chambers, by virtue of the fact that it presents a greater surface area exposed to the steam.

18. The engine as defined in claim 1, wherein said stator body further has an exhaust port that extends transversely from, and opens into, said second face of said stator body of said stator, to, and communicates tangentially with, said throughchamber in said stator body of said stator, and has a branch that extends transversely therefrom into said throughchamber in said stator body of said stator to allow for full exhaust as the rotor rotates to its only tangential contact point with the stator.

19. The engine as defined in claim 1, wherein said steam generating apparatus comprises a high intensity arc mechanism for converting the water entering said steam generating chamber in said stator body of said stator, through said intake port in said stator body of said stator, into the steam.

20. The engine as defined in claim 1, wherein said steam generating apparatus comprises a laser beam generator mechanism for converting the water entering said steam generating chamber in said stator body of said stator, through said intake port in said stator body of said stator, into the steam.

21. The engine as defined in claim 1, wherein said steam generating apparatus comprises a heating element mechanism for converting the water entering said steam generating chamber in said stator body of said stator, through said intake port in said stator body of said stator, into the steam.

* * * * *